US006217967B1

(12) United States Patent
Bobrowicz

(10) Patent No.: US 6,217,967 B1
(45) Date of Patent: Apr. 17, 2001

(54) CORE FOR SNOWBOARD

(75) Inventor: Eric Bobrowicz, Le Freyssinet (FR)

(73) Assignee: Skis Rossignol, S.A. (FR)

( * ) Notice: Subject to any disclaimer, the term of this patent is extended or adjusted under 35 U.S.C. 154(b) by 0 days.

(21) Appl. No.: 09/208,321

(22) Filed: Dec. 9, 1998

(30) Foreign Application Priority Data

Dec. 10, 1997 (FR) ..... 97 15898

(51) Int. Cl.[7] ..... B32B 3/14

(52) U.S. Cl. ..... 428/56; 428/316.6; 428/317.1; 428/317.9

(58) Field of Search ..... 428/53, 316.6, 428/317.9, 317.1, 315.9, 56

(56) References Cited

U.S. PATENT DOCUMENTS 3,902,732 * 9/1975 Fosha, Jr. et al. ..... 280/11.23 L
4,068,840 * 1/1978 Spaulding, Jr. ..... 272/3
4,925,719 * 5/1990 Staneluis et al. ..... 428/71
5,543,225 * 8/1996 Mueller et al. ..... 428/423.1
5,759,664 * 6/1998 Chisnell ..... 428/109
5,769,445 * 6/1998 Morrow ..... 260/610

* cited by examiner

*Primary Examiner*—Blaine Copenheaver
(74) *Attorney, Agent, or Firm*—Richard P. Gilly

(57) ABSTRACT

This invention relates to a core for a snowboard, made by the adhesive bonding, side by side, of a plurality of longitudinal bands whose height is that of the core and whose width preferably does not exceed 25 millimeters, each of these bands being made of a material constituted either by wood, by a synthetic foam or by a fiber-reinforced synthetic foam, the overall percentage of each of these three materials in the core thus constituted depending on the type of snowboard that it is desired to produce with the aid of this core.

16 Claims, 1 Drawing Sheet

CORE FOR SNOWBOARD

FIELD OF THE INVENTION

The present invention relates to a core for a snowboard.

BACKGROUND OF THE INVENTION

Contrary to the ski or a monoski, the snowboard is used asymmetrically, the user having neither his body nor his feet directed along the longitudinal axis of the board, but placed markedly obliquely with respect thereto. The surfer's body is placed oblique with respect to his board with either the right foot to the rear and the left foot in front, for persons with right directing foot ("regular foot") or, for persons with left directing foot ("goofy foot"), the left foot to the rear and the right foot at the front. The spaced apart relationship of the feet depends on the user's morphology and essentially on his size. The tips of the feet are more or less turned towards the front of the snowboard, this orientation being indicated by an angle measured from the perpendicular to the longitudinal axis of the snowboard. This orientation may generally vary, for the rear foot, between 0 and about 40 degrees and, for the front foot, between 10 and 45 degrees, the position preferred at the present time by numerous high-level surfers being the so-called intermediate position:

rear foot: angle of orientation included between 10 and 15 degrees, front foot: angle of orientation included between 30 and 45 degrees.

As the case may be, the surfer's body is oblique with respect to the snowboard and to the direction of his displacement. Bends are taken either by leaning the body forwards, towards the tips of the foot (or, more simply, "front-side"), or by leaning the body backwards, towards the heels (or "back-side"). The center of gravity of the surfer then moves along an axis whose orientation is substantially the bisecting line of the angle formed by his two feet.

Originally, the snowboard was mainly intended to be used off-piste in answer to a demand particularly centered on freedom and therefore the search for a new way to glide in wide open spaces, away from the crowds on the runs.

Later, this practice was divided into two specialties:

"Free snowboarding" (or "free ride") which combines passages on marked runs and off-piste, "Figures" (or "free style") on especially arranged runs, including parts in relief allowing jumps to be made.

Finally, like Alpine skiing, certain practitioners have felt the need to match themselves against one another in competitions on slalom or downhill runs. This activity will be classified overall as "Alpine snowboarding".

This craze for snowboarding is also affecting persons other than the very young, with the result that it is also becoming necessary to provide, on the one hand, snowboards for women, presenting qualities of lightness and comfort, and, on the other hand, "general public" snowboards presenting qualities of comfort without being too detrimental to efficiency and lightness.

A snowboard is conventionally constituted, from bottom to top:

by a gliding surface composed of a sole for gliding bordered by metal edges, by a lower reinforcing layer, either fibrous or metallic, by a core, by an upper reinforcing layer, either fibrous or metallic, by a protecting and decoration-supporting foil, made either in the form of a shell and therefore constituting the top and sides of the board, or existing solely on the upper face of the board and therefore, in that case, in abutment on protecting elements bordering the core and called sidewalls.

More particularly, for producing a snowboard, the mechanical characteristics of the core constituting the internal part must be adapted, due to the width thereof which is much larger than is necessary for producing a ski.

These particular characteristics are obtained at the present time either by dimensional values, by appropriate internal reinforcements, or by the nature of the components, particularly concerning the core. It may be noted, for example, that:

A core made of wood is very tonic, heavy, slightly vibrating, and of relatively low cost price. It improves the mechanical characteristics of stiffness (vivacity, nervosity), of resistance to deformation, of resistance to tear of the screws maintaining the shoe bindings, as well as the characteristics of adhesion.

Compared to a core made of wood, a core made of synthetic foam is lighter, less tonic, much dampened, but slightly more expensive if it is question of a fiber-reinforced polyurethane foam; much less expensive due to its easy use and completely inert if it is question of a polyurethane foam; and even more dampening but much more expensive if it is question of an acrylic foam.

The invention makes it possible to respond, by a very particular constitution of the core of snowboard, therefore forming the subject matter of the invention, to all the specific uses of this board, and consequently to be able to produce either an "Alpine" snowboard for runs, a "free style" snowboard for acrobatics, or a multi-use "free ride" board.

SUMMARY OF THE INVENTION

To that end, it relates to a core for a snowboard, characterized in that it is made by assembling, side by side, a plurality of longitudinal bands of which the height is that of the core, each of these bands being made of a material constituted either by wood, by a synthetic foam, or by a fiber-reinforced synthetic foam, the respective percentage of each of these three materials in the core thus constituted depending on the type of snowboard which it is desired to produce by using this core.

These various longitudinal bands are preferably assembled by adhesive bonding.

According to one embodiment, the width of each band does not exceed 25 millimeters.

BRIEF DESCRIPTION OF THE DRAWINGS

The invention will be more readily understood on reading the following description with reference to the accompanying drawings, in which.

DESCRIPTION OF PREFERRED EMBODIMENT

Figure 1:
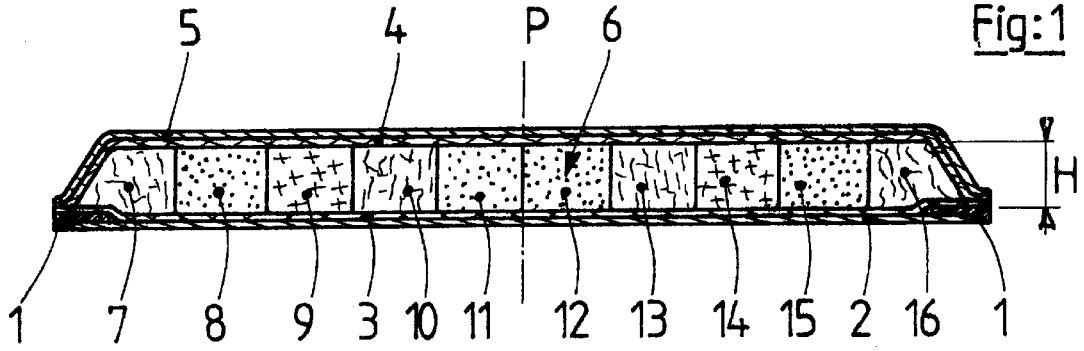
FIG. 1 is a cross-section of a snowboard equipped with a core according to the invention.

Referring now to the drawings, and firstly to FIG. 1, a snowboard is shown, which is symmetrical with respect to its median longitudinal plane P and which comprises:

A sole 2 for gliding, bordered by metallic edges 1 surmounted by a fibrous reinforcing layer 3;

A central core 6 forming the heart of the snowboard. It should be noted that this core laterally follows the shape of the inclined edges of this snowboard;

A plastic protecting foil 5 in the form of shell, itself internally lined with a fibrous reinforcing layer 4.

According to the invention, the core 6 is composed of a plurality of longitudinal bands, in the present case ten bands numbered from 7 to 16, assembled side by side and preferably by adhesive bonding, of which the height (H) is that of the core, each of these bands being made of a material constituted either by wood, by a synthetic foam or by a fiber-reinforced synthetic foam, the respective percentage of each of these three materials in the core thus constituted depending on the type of snowboard that it is desired to produce by using this core.

Figure 2:
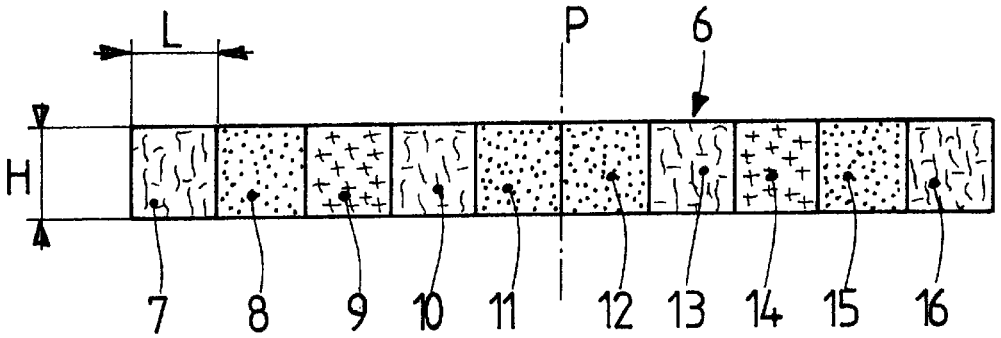
FIG. 2 is a cross-section of a core according to the invention and more particularly adapted to the practice of Alpine snowboarding.

A core similar to the one which equips the snowboard of FIG. 1 but rathermore intended for a "traditional" board of substantially rectangular cross-section, is shown in FIG. 2.

Its bands referenced 7, 10, 13, 16 are, like those of the core of the snowboard of FIG. 1, made of wood.

Its bands referenced 8, 11, 12, 15 are, like those of the core of the snowboard of FIG. 1, made of synthetic foam, typically polyurethane foam or acrylic foam.

Its bands referenced 9 and 14 are, like those of the core of the snowboard of FIG. 1, made of synthetic foam, typically polyurethane foam reinforced with fibers, typically glass fibers, carbon fibers, aramid fibers, etc.

The cores according to FIGS. 1 and 2 are cores more especially adapted for the practice of Alpine snowboarding.

It should be noted that a snowboard has a height which varies at different points of its length, and that its core 6 consequently presents a height H which varies under the same conditions, i.e. increasing from the tip zone to the binding mounting zone, then decreasing from the latter zone as far as the tail zone.

In this precise example, the snowboard has a variable width at each point of its length, thus defining in particular a narrower zone in the central part or binding mounting zone. Consequently, the bands, 7 and 16 in particular, of the core 6 which are located on the edges, present a variable width all along the snowboard, while the others have a constant width.

In FIG. 2, all the bands are of the same width L in the transverse plane considered, in the present case of the order of 20 millimeters, but they may also be of different width, with, however, a general preference for band widths not exceeding about 25 millimeters for each band, whether they are of uniform width or not.

It should be noted that two adjacent bands are not necessarily made of different materials: for example, adjacent bands 11 and 12 are constituted by the same material.

The dimensions of the different bands in width, their number and their respective constituent materials are determined by the constructor in order to obtain the snowboard having the desired characteristics, as a function of the following criteria:

For an "Alpine" snowboard which must be dampened, tonic, without taking too much account of the weight, the core must be constituted by about 40% (or more generally from 30% to 50%) of polyurethane, about 40% (or more generally from 30% to 50%) of wood, and by about 20% (or more generally from 10% to 30%) of fiber-reinforced polyurethane; this is the case for the snowboard according to FIG. 1, as well as for a snowboard having a core according to FIG. 2.

Figure 3:
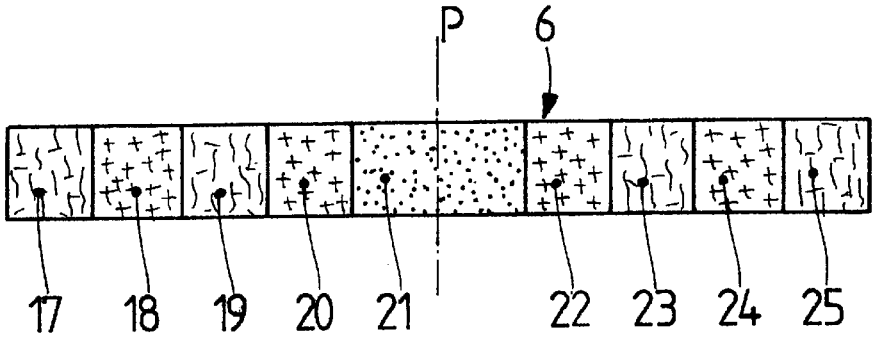
FIG. 3 is a cross-section of a core according to the invention and more particularly adapted to the practice of acrobatics ("free style").

For a "free style" snowboard, which must be tonic and light, the core must be constituted by about 20% (or more generally from 10% to 30%) of polyurethane, about 40% (or more generally from 30% to 50%) of wood, and by about 40% (or more generally from 30% to 50%) of fiber-reinforced polyurethane: this is the case of a snowboard having a core such as the one shown in FIG. 3, identical in outer dimensions to that of FIG. 2 and always symmetrical with respect to plane P, but for which the ten bands 7 to 16 are replaced by nine bands 17 to 25, comprising, as shown, four bands 17, 19, 23, 25 made of wood, a median band 21 made of fiber-reinforced synthetic foam and wider than the other bands, and four bands 18, 20, 22, 24 made of fiber-reinforced synthetic foam. It should be noted that said proportions of 20%, 40%, 40% are obtained either with bands of the same width, typically less than 25 millimeters, and by playing on their number, or by playing on the respective width of each.

Figure 4:
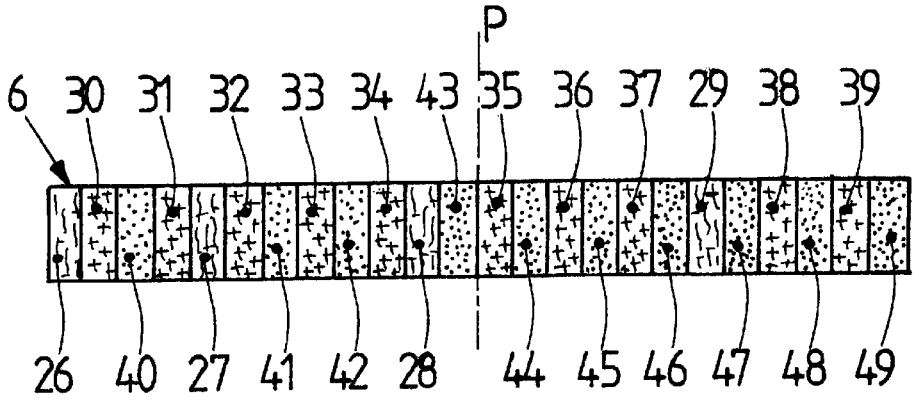
FIG. 4 is a cross-section of a core according to the invention and more particularly adapted to the practice of "free ride" snowboarding.

For a "free ride" which must be dampened, fairly inert, and light, the core must be constituted by about 40% (or more generally from 30% to 50%) of polyurethane, about 20%, (or more generally from 10% to 30%) of wood, and by about 40% (or more generally from 30% to 50%) of fiber-reinforced polyurethane: this is the case of a snowboard having a core such as, the one shown in FIG. 4, of which the composition is in addition, on the one hand (by way of illustration of the non-limiting character of the invention) asymmetrical with respect to the median longitudinal plane P of the board, therefore of the core, and, on the other hand, formed by the edge-to-edge adhesive bonding of a larger number of bands (twenty four bands 26 to 49 in all) which are all of the same width. More precisely, this core is constituted by the side-by-side assembly of:

To the left: three bands 26 to 28 made of wood, five bands 30 to 34 made of fiber-reinforced polyurethane, and four bands 40 to 43 made of polyurethane.

To the right: one band 29 made of wood, five bands 35 to 39 made of fiber-reinforced polyurethane, and six bands 44 to 49 made of polyurethane.

What is claimed is:

1. A core for a snowboard, the core comprising a plurality of longitudinal bands of which the height is that of the core, the bands being assembled side by side, each of these bands being made of a material selected from the group consisting of wood, synthetic foam, and a fiber-reinforced synthetic foam, with at least one band made from wood, at least one band made from synthetic foam, and at least one band made from fiber-reinforced synthetic foam, the respective percentage of each of these three materials in the core thus constituted depending on the characteristics of snowboard which it is desired to produce by using this core.

2. The core of claim 1, wherein these various bands are assembled by adhesive bonding.

3. The core of claim 1, wherein the width of each of these bands does not exceed 25 millimeters.

4. The core of claim 1, wherein, for the different bands, at least one of the width, the number, and the respective constituent materials of the bands is selected to obtain respective material proportions intended to obtain a snowboard which must be tonic and dampened, as a function of the following criteria: this core must be constituted from 30% to 50% of synthetic foam, from 30% to 50% of wood, and from 10% to 30% of fiber-reinforced synthetic foam.

5. The core of claim 4, wherein it is constituted by about 40% of synthetic foam, 40% of wood, and 20% of fiber-reinforced synthetic foam.

6. The core of claim 1, wherein, for different bands, at least one of the width, the number, and the respective constituent materials is determined to obtain respective material proportions intended to obtain a snowboard which must be tonic, light and slightly vibrating, as a function of the following criteria: this core must be constituted from 10% to 30% of synthetic foam, from 30% to 50% of wood, and from 30% to 50% of fiber-reinforced synthetic foam.

7. The core of claim 6, wherein it is constituted by about 20% of synthetic foam, 40% of wood, and 40% of fiber-reinforced synthetic foam.

8. The core of claim 1, wherein, for the different bands, at least one of the width, the number, and the respective constituent materials is selected to obtain respective material proportions intended to obtain a snowboard which must be dampened, fairly inert and light, as a function of the following criteria: this core must be constituted from 30% to 50% of synthetic foam, from 10% to 30% of wood, and from 40% to 50% of fiber-reinforced synthetic foam.

9. The core of claim 8, wherein it is constituted by about 40% of synthetic foam, 20% of wood, and 40% of fiber-reinforced synthetic foam.

10. The core of claim 1, wherein it is symmetrical with respect to the median longitudinal plane of the snowboard.

11. The core of claim 1, wherein it is asymmetrical, at least in quantities of each of the three respective materials, with respect to the median longitudinal plane of the snowboard.

12. The core of claim 1, wherein said synthetic foams are polyurethane foams.

13. The core of claim 1, wherein said synthetic foams are acrylic foams.

14. The core of claim 1, wherein said fiber-reinforced synthetic foams are foams reinforced with glass fibers.

15. The core of claim 1, wherein said fiber-reinforced synthetic foams are foams reinforced with carbon fibers.

16. The core of claim 1, wherein said fiber-reinforced synthetic foams are foams reinforced with Aramid fibers.

* * * * *